United States Patent [19]

Neyraud

[11] 3,995,418

[45] Dec. 7, 1976

[54] DOUBLE TWIST SPINDLE YARN STOP DEVICE

[75] Inventor: Rene Neyraud, Saint Cyr au Mont d'Or, France

[73] Assignee: Verdol S.A., Caluire (Rhone), France

[22] Filed: Aug. 5, 1975

[21] Appl. No.: 602,038

[30] Foreign Application Priority Data

Aug. 12, 1974 France ..... 74.28643

[52] U.S. Cl. ..... 57/80

[51] Int. Cl.[2] ..... D01H 13/16

[58] Field of Search ..... 57/78, 80, 81, 83, 82, 57/84, 87, 86

[56] References Cited

UNITED STATES PATENTS

| | | | |
|---|---|---|---|
| 2,840,979 | 7/1958 | Harmon | 57/80 X |
| 3,517,497 | 6/1970 | Rettenmund | 57/81 |
| 3,568,425 | 3/1971 | Zegna et al. | 57/81 |

*Primary Examiner*—John Petrakes
*Attorney, Agent, or Firm*—Dowell & Dowell

[57] ABSTRACT

A double twist spindle yarn stop device of the type fitted with a thread feeler lever arm for automatic stopping of the untimely unwinding of the thread in the event of its untimely accidental breakage, the device operating by descending to a lowered position overlying a spool of the textile twisting machine on which the device is used, the stop device being characterized by a stirrup provided at the free end of the thread feeler lever arm, said stirrup having depending shanks laterally displaced with respect to the thread guide to fall therepast, and disposed to straddle the hollow spindle and rest on a centering tip carried therearound above the spool, the thread wrapping around the shanks of the stirrup and being stopped by binding thereon.

4 Claims, 3 Drawing Figures

DOUBLE TWIST SPINDLE YARN STOP DEVICE

The present invention concerns double twist spindle and yarn stop devices for textile twisting machines.

When it is desired to subject a thread wound on a spool to a double twist, said spool is placed in a pot-shaped member maintained at a predetermined angle on a suitably rotated hollow spindle; the thread leaves the spool to pass through the spindle, then issues radially therefrom on a level with the bottom of the pot and is guided towards a take-up winding drum by entering a thread guide disposed on the geometrical axis of the spool. The thread describes what is termed a balloon around the pot during twisting.

If the thread breaks after leaving the spindle, the centrifugal force developed by the free length of thread produces a tension on the latter upstream of the break in such manner that the thread continues to unwind from the spool. If the user does not immediately perceive the break of the thread, it becomes wound up and tangled on the different members of the machine, thus involving considerable difficulties.

Some devices are fitted with a diametrically opposed arm or "coronelle," the two ends of which each comprise an eyelet through which the thread passes, the arm turning with the spindle, and a thread feeler lever which is pivoted on a fixed point of the machine is held in an upwardly oblique position above the thread guide with its free end resting upon the stretched thread. When the thread breaks, the lever, which is called a "thread feeler," drops and immobilises the arm or "coronelle," so that the thread is retained by the eyelet of the latter and cannot continue to unwind from the spool.

The disadvantage of such a system resides in the feature that, under the torsion stress exerted by the tensioned thread on the "coronelle" arm, the latter or another member frequently breaks and this results in long and tedious work to put things right.

The object of the present invention is to obviate these disadvantages and to enable a system to be produced for arresting the broken thread, such system responding particularly well to the various requirements of practise.

According to the present invention, the free end of the thread feeler lever is provided with a bifurcated stirrup which, upon breakage of the thread, drops down and becomes disposed around and straddles the end of the spool-holding tube and above the conical centering member centered on the spool relative to the tube, whereupon the thread wraps around the two shanks of the bifurcated stirrup and is arrested thereby The invention will be further described by way of example, with reference to the accompanying drawings in which.

Figure 1:
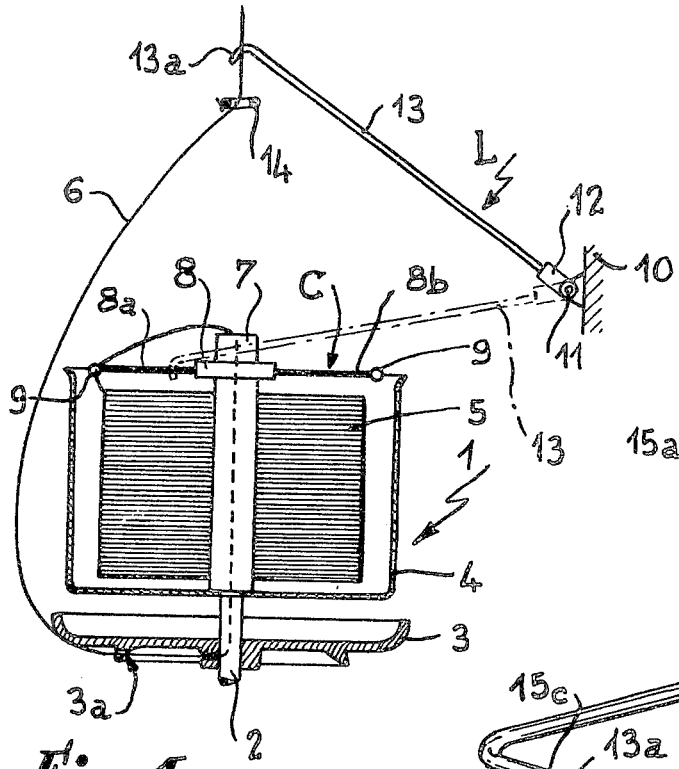
Fig. 1 PRIOR ART
FIG. 1 is a schematic view of a double twist spindle device fitted with a typical prior art coronelle arm and a feeler lever capable of stopping the rotation of the arm in the event of a breakage of the thread, in the conventional manner.

FIG. 1 is a view of a prior art double twist spindle device 1 which comprises a spindle 2 associated with a disc 3; the spindle is hollow and mounted loosely in relation to a pot 4 which contains the spool 5 on which the thread 6 is wound.

The spool is mounted in the usual manner on a tube 7, stationary in relation to the pot 4 on the upper end of which there is mounted to rotate freely a hub 8 provided with two radial arms 8*a*, 8*b* diametrally opposed to each other and each provided at their ends with an eyelet 9. The assembly C of the hub 8 and the arms 8*a*, 8*b* represents what is called a "coronelle" or snake arm in the technique of spooling.

The frame 10 of the twisting machine has a fixed shaft 11 around which there is mounted, to rotate freely, a clevise 12 which mounts a lever arm 13 in the form of a metal rod, the free end 13*a* of which is bent, the assembly 12–13 forming a thread feeling lever L.

The thread 6 leaves the spool in a rising vertical direction, then it passes into the centre bore of the shaft 2 from which it deports radially by passing through an opening 3*a* in the disc 3. It subsequently balloons around the pot 4 to pass into a thread guide 14 located above the pot and in line with the axis of the spindle 2. The thread 6 is drawn on a suitable drum, (not shown) so that it is under tension.

In the conventional prior art device shown in FIG. 1, upon leaving the spool 5, the thread passes through one of the eyelets 9 of the assembly C so that the latter rotates round the tube 7, being driven by the thread. The end 13*a* of the rod 13 rests against the thread 6. If said thread breaks, the feeler lever 12–13 falls by its own weight to the dashed line position shown in FIG. 1, and now co-operates with the upper part of the spool. As explained above, when the thread breaks it continues to unwind from the spool, so that the coronelle arm continues to turn until the rod 13 locks it by having its hooked end 13*a* engage one arm 8*a* or 8*b* of the coronelle.

Figure 2:
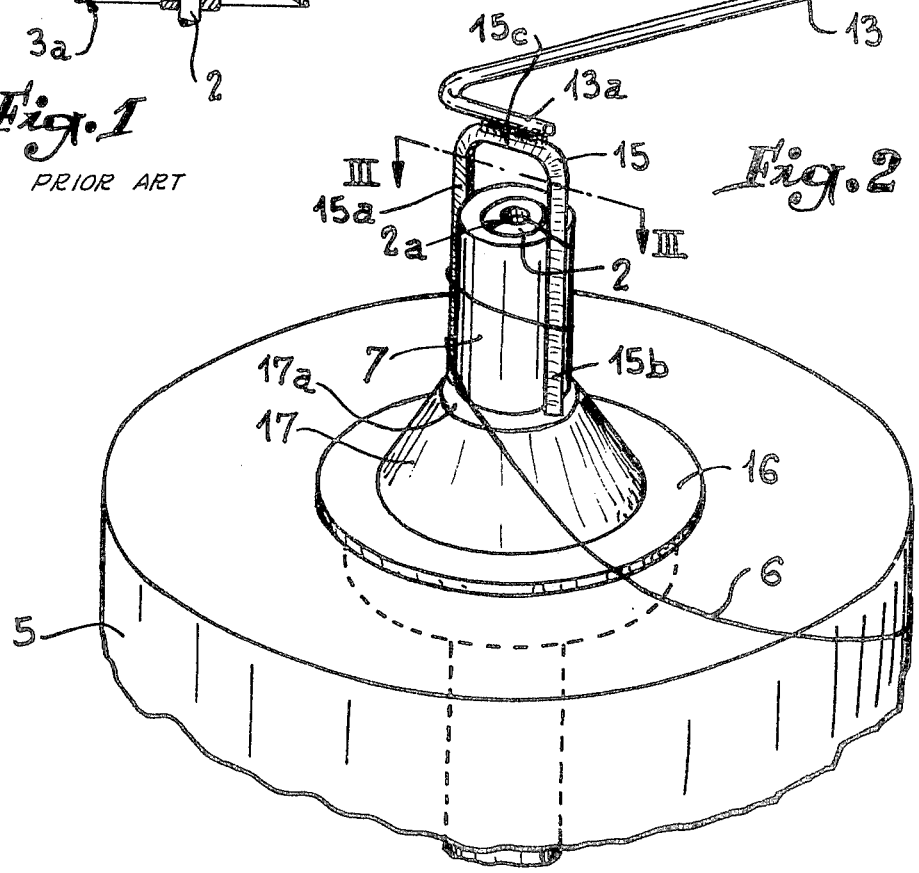
FIG. 2 is an enlarged perspective view of an embodiment of the device according to the invention.

In accordance with the present invention, the end of the rod 13 is provided with a stirrup 15 of a general U-shape, the shanks 15*a* and 15*b* which are directed vertically when the lever is in lowered position, as shown in FIG. 2, that is to say, the position it adopts when the thread has broken. It should be noted that the spool 5, which according to this invention is not associated with any coronelle C, is centered in relation to the tube 7 by means of a centering tip 16 having an upper boss 17 of downwardly flairing truncated cone shape. This boss also has an upper annular face 17*a* on which the two free ends of the stirrup 15 rest when the lever L is in lowered position.

Figure 3:
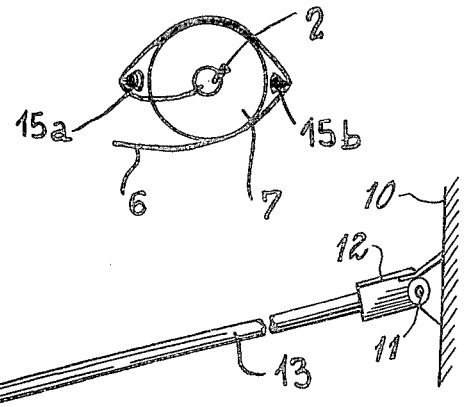
FIG. 3 is a partial cross-section of the end of the device taken on the line III—III of FIG. 2.

As shown in FIG. 3, the two shanks 15*a* and 15*b* of the stirrup 15 have in cross-section the shape of a triangle, the base of which is adjacent to the tube 7, whilst the apex of each thereof extends outwardly, each shank thus presenting an outwardly facing sharp longitudinal ridge.

Operation of the device will be apparent from the foregoing explanations:

In normal operation, the crosspiece 15*c* of the stirrup rests against the thread above the thread guide 14 in the same elevated position as shown in FIG. 1. In the event of the breakage of this thread, the lever L is lowered, the two shanks 15*a* and 15*b* passing to one side of the guide 14, because its rod 13 is displaced to one side of the latter. The stirrup 15 thus rests on the face 17*a* of the conical part 17 of the central tip 16. The thread 6 which issues from the bore 2*a*, FIG. 2, of the spindle 2 and tends to continue to sweep radially across the space above the spool, becomes wound around the non-rotating shanks of the stirrup 15 on which it becomes wrapped (FIGS. 2 and 3). Under these conditions the thread is prevented from further unwinding and the operator can easily intervene to put things in order.

The above described arrangement permits simplification of each working position of twine machines and, moreover, its adaptation to existing machines is extremely easy, since it is only necessary to replace the normally used thread guide lever and to omit the usual coronelle arm C.

We claim:

1. In a thread twisting machine of the type having a hollow spindle for supporting a bobbin and having a free end extending beyond the bobbin, and the machine having feed means for continuously drawing a thread from the bobbin through the free end of said hollow spindle, and the machine having a vertically swingable thread feeler lever arm having an outer end normally supported above the spindle by the thread being drawn from the bobbin but dropping down toward the spindle to a lowered position in the event the thread breaks, an improved device for stopping unwinding of the thread when it has broken, comprising: a centering tip around the free end of the spindle and resting on the bobbin; and a bifurcated stirrup fixed to the outer end of the lever arm and opening downwardly, the stirrup being positioned on the lever arm so that when the arm is in lowered position, the stirrup overlies the free end of the spindle.

2. In a device as set forth in claim 1, said stirrup having opposed shanks which are vertical when the lever arm is in lowered position and which straddle the free end of the spindle.

3. In a device as set forth in claim 1, said centering tip having a central opening to receive said spindle and having an annular upper face surrounding the spindle below its free end, and said stirrup having opposed shanks which are vertical when the lever arm is in lowered position and which straddle the free end of the spindle, and the shanks having lower ends which in said lowered position rest on said annular upper face.

4. In a device as set forth in claim 1, said stirrup having opposed shanks which are vertical when the lower arm is in lowered position and which straddle the free end of the spindle, the shanks being triangular in cross-section and each having a flat surface facing toward the spindle and an apex facing outwardly from the spindle.

* * * * *